US012305872B2

(12) United States Patent
Mai et al.

(10) Patent No.: US 12,305,872 B2
(45) Date of Patent: May 20, 2025

(54) MULTI-SPLIT SYSTEM WITH PARTITIONED CONTROL AND SELF-IDENTIFICATION CONTROL METHOD THEREOF

(71) Applicant: Guangdong Giwee Technology Co. Ltd., Foshan (CN)

(72) Inventors: Xiangshi Mai, Guangdong (CN); Huandi Yang, Guangdong (CN)

(73) Assignee: GUANGDONG GIWEE TECHNOLOGY CO. LTD., Foshan (CN)

( * ) Notice: Subject to any disclaimer, the term of this patent is extended or adjusted under 35 U.S.C. 154(b) by 374 days.

(21) Appl. No.: 17/865,564

(22) Filed: Jul. 15, 2022

(65) Prior Publication Data

US 2023/0013910 A1 Jan. 19, 2023

(30) Foreign Application Priority Data

Jul. 16, 2021 (CN) ..... 202110808104.5

(51) Int. Cl.
*F24F 11/63* (2018.01)

(52) U.S. Cl.
CPC ..... *F24F 11/63* (2018.01)

(58) Field of Classification Search
CPC ..... F24F 11/63
See application file for complete search history.

(56) References Cited

U.S. PATENT DOCUMENTS 6,301,922 B1 * 10/2001 Ochi ..... F25B 9/004 62/402
2013/0145786 A1 * 6/2013 Tamaki ..... F24F 11/86 62/161
2019/0368754 A1 * 12/2019 Blanton ..... G05D 23/1919

FOREIGN PATENT DOCUMENTS

CN 104813112 A 7/2015
CN 105650770 A 6/2016
CN 205619614 U 10/2016
CN 212538020 U 2/2021
(Continued)

OTHER PUBLICATIONS

Chinese Office Action for Application No. 202110808104.5, Issued Mar. 16, 2022, 9 Pages.
(Continued)

*Primary Examiner* — Mark A Connolly
(74) *Attorney, Agent, or Firm* — CANTOR COLBURN LLP

(57) ABSTRACT

The invention discloses a multi-split system with partitioned control. An output end of a compressor is in communication with first interfaces of a first four-way valve, a second four-way valve, and a third four-way valve respectively, a third interface of the first four-way valve is in communication with one end of an outdoor heat exchanger, a second interface of the second four-way valve is in communication with one end of one indoor unit set therein, a third interface of the third four-way valve is in communication with one end of the other indoor unit set, and the other end of the outdoor heat exchanger and the other ends of the indoor unit sets are in communication with each other in a convergence manner; the remaining interfaces of the second four-way valve and the third four-way valve are all in communication with an air return end of the compressor.

8 Claims, 4 Drawing Sheets

(56) References Cited

FOREIGN PATENT DOCUMENTS

| | | | |
|---|---|---|---|
| CN | 113007830 | A | 6/2021 |
| EP | 2725310 | A1 | 4/2014 |
| EP | 4006452 | A1 | 6/2022 |
| JP | H02223776 | A | 9/1990 |
| WO | 2021014640 | A1 | 1/2021 |

OTHER PUBLICATIONS

European Search Report for Application No. 22185318.7, Issued Nov. 18, 2022, 10 Pages.

* cited by examiner

MULTI-SPLIT SYSTEM WITH PARTITIONED CONTROL AND SELF-IDENTIFICATION CONTROL METHOD THEREOF

FOREIGN PRIORITY

This application claims priority to Chinese Patent Application No. 202110808104.5, filed Jul. 16, 2021, and all the benefits accruing therefrom under 35 U.S.C. § 119, the contents of which in its entirety are herein incorporated by reference.

TECHNICAL FIELD

The present disclosure relates to the technical field of refrigeration equipment control, and in particular, to a multi-split system with partitioned control and self-identification control method thereof.

BACKGROUND

The existing multi-split system has a single function and can only perform a cooling or heating function for a single indoor environment, that is, all indoor units perform cooling or all indoor units perform heating, so that indoor units in a certain area cannot operate in different modes. Furthermore, if it is needed to realize a partitioned cooling or heating function in different areas, two sets of equipment are required, which results in high equipment cost, and doubles the amount of construction work.

In addition, in the existing multi-split system, if one indoor system is in cooling mode and another indoor system is in heating mode, when the heating demand is high and the heating system needs to defrost, then, the heating system needs to reverse the four-way valves, change the mode of indoor units, and use the heat generated by the compressor to defrost. However, this reduces the effective heating time of the heating indoor unit of the air conditioner, which results in low effective utilization rate of the equipment. At the same time, in order to reduce the influence of the defrosting process on the indoor ambient temperature and not starting up the indoor unit, generally, in the defrosting process, the indoor unit will enter a cold wind protection mode, the indoor unit fan is not started, and a large amount of liquid refrigerant flows through the indoor unit and returns to the compressor. This process is more likely to cause liquid shock to the compressor, which affects the life of the compressor and the reliability of the system. The process of controlling the four-way valves of the indoor units to reverse may cause a large refrigerant impact noise on the indoor side accompanying with a large refrigerant flow sound, which affects the user experience. If non-stop defrosting is to be achieved, a phase change heat storage module needs to be added or the outdoor heat exchanger needs to be modified, and a dual heat exchanger is used to perform non-stop defrosting. However, by adding a phase change heat storage module or using a dual heat exchanger to achieve non-stop defrosting, additional cost and equipment space are required, which results in a large volume of equipment and a high overall cost. Furthermore, this defrosting method also causes waste of energy.

SUMMARY

An object of the present disclosure is to overcome the deficiencies of the prior art, and provide a multi-split system with partitioned control and self-identification control method thereof, which has the characteristics of low cost and high efficiency.

In order to achieve the above object, the multi-split system with partitioned control provided by the present disclosure includes a compressor, an outdoor heat exchanger, two indoor unit sets, a first four-way valve, a second four-way valve, and a third four-way valve, each of the indoor unit sets is composed of one or more indoor units arranged in parallel; an output end of the compressor is in communication with first interfaces of the first four-way valve, the second four-way valve and the third four-way valve respectively, a third interface of the first four-way valve is in communication with one end of the outdoor heat exchanger, a second interface of the second four-way valve is in communication with one end of one indoor unit set therein, a third interface of the third four-way valve is in communication with one end of the other indoor unit set, and the other end of the outdoor heat exchanger is in communication with the other ends of the indoor unit sets in a convergence manner; the remaining interfaces of the second four-way valve and the third four-way valve are all in communication with an air return end of the compressor; and by independently adjusting the power on/off actions of the second four-way valve and the third four-way valve, a heating mode or a cooling mode of each indoor unit set is controlled correspondingly and independently.

Further, each indoor unit is configured with a room temperature sensor for detecting and obtaining an indoor ambient temperature T1, a refrigerant temperature sensor for detecting and obtaining an outlet temperature T2B, and a coil temperature sensor for detecting and obtaining a coil temperature T2.

A self-identification control method for a multi-split system with partitioned control comprises the following steps: S1: detecting and obtaining, before completion of wiring and initial startup of the system, a standby temperature parameter Ta of each indoor unit before it is turned on; S2: powering on and initially starting the system, controlling the first four-way valve, the second four-way valve and the third four-way valve to be powered off, so that the first interface D of each four-way valve is connected with the third interface C of the four-way valve, then continuously running for a rated time, and detecting and obtaining the current operating temperature parameter Tb of each indoor unit; S3: sequentially comparing the standby temperature parameter Ta and the operating temperature parameter Tb of each indoor unit, wherein the indoor unit whose standby temperature parameter Ta is greater than the operating temperature parameter Tb is initially classified into an indoor unit set A, and the indoor unit whose standby temperature parameter Ta is less than the operating temperature parameter Tb is initially classified into an indoor unit set B; S4: controlling the first four-way valve to be powered off, controlling the second four-way valve and the third four-way valve to be powered on for reversing, so that both the second four-way valve and the third four-way valve are reversed and the first interfaces thereof are connected with the second interfaces, then continuously running for a rated time, and detecting and obtaining the current operating temperature parameter Tc of each indoor unit; S5. sequentially comparing the standby temperature parameter Ta and the operating temperature parameter Tc of each indoor unit, wherein the indoor unit whose standby temperature parameter Ta is less than the operating temperature parameter Tc is initially classified into the indoor unit set A, and the indoor unit whose standby temperature parameter Ta is greater than the operating temperature parameter Tc is initially classified into the indoor unit set B; and S6: checking and comparing the classification results of each indoor unit in steps S3 and S5, wherein if the two classification results of any indoor unit are the same, it is determined that the indoor unit is normally wired and the indoor unit is marked as that its corresponding indoor unit set A or B has been confirmed.

Further, the standby temperature parameter Ta, the operating temperature parameter Tb, and the operating temperature parameter Tc are any one or more temperature parameter(s) of the indoor ambient temperature T1, the outlet temperature T2B, and the coil temperature T2.

Further, the standby temperature parameter Ta, the operating temperature parameter Tb, and the operating temperature parameter Tc include three temperature parameters of indoor ambient temperature T1, outlet temperature T2B, and coil temperature T2.

Further, in step S3, for any indoor unit, if the standby temperature parameter Ta>the operating temperature parameter Tb, the indoor ambient temperature T1>the outlet temperature T2B, and the indoor ambient temperature T1>the coil temperature T2, the indoor unit is initially classified into the indoor unit set A; if the standby temperature parameter Ta<the operating temperature parameter Tb, the indoor ambient temperature T1<the outlet temperature T2B, and the indoor ambient temperature T1<the coil temperature T2, the indoor unit is initially classified into the indoor unit set B.

Further, in step S5, for any indoor unit, if the standby temperature parameter Ta<the operating temperature parameter Tc, the indoor ambient temperature T1<the outlet temperature T2B, and the indoor ambient temperature T1<the coil temperature T2, the indoor unit is initially classified into the indoor unit set A; if the standby temperature parameter Ta>the operating temperature parameter Tc, the indoor ambient temperature T1>the outlet temperature T2B, and the indoor ambient temperature T1>the coil temperature T2, the indoor unit is initially classified into the indoor unit set B.

Further, the rated time is 20 min.

The present disclosure adopts the above solution, and the beneficial effects thereof are as follows: 1) by providing the self-identification control method, after the multi-split wiring is completed, area division identification and error correction determination of the wiring can be performed, and the operation is convenient; 2) by using one multi-split system, cooling and heating modes in different areas can be achieved, so as to achieve the purpose of reducing cost and improving efficiency.

3) by optimizing a multi-split system, especially when defrosting abnormality occurs, non-stop defrosting can be achieved, avoiding the influence on the indoor unit sets with heating demand, and energy recovery is performed by using the indoor unit sets with cooling demand, so as to improve the reliability and energy-saving performance of the system during operation.

wherein 1—compressor, 2—outdoor heat exchanger, 3—indoor unit set, 4—first four-way valve, 5—second four-way valve, and 6—third four-way valve.

DETAILED DESCRIPTION

In order to facilitate understanding of the present disclosure, the present disclosure will be described more fully hereinafter with reference to the accompanying drawings. Preferred embodiments are given in the accompanying drawings. However, the present disclosure may be implemented in many different forms and is not limited to the embodiments described herein. The purpose of providing these embodiments is to make more thorough and complete understanding of the disclosure.

Figure 1:
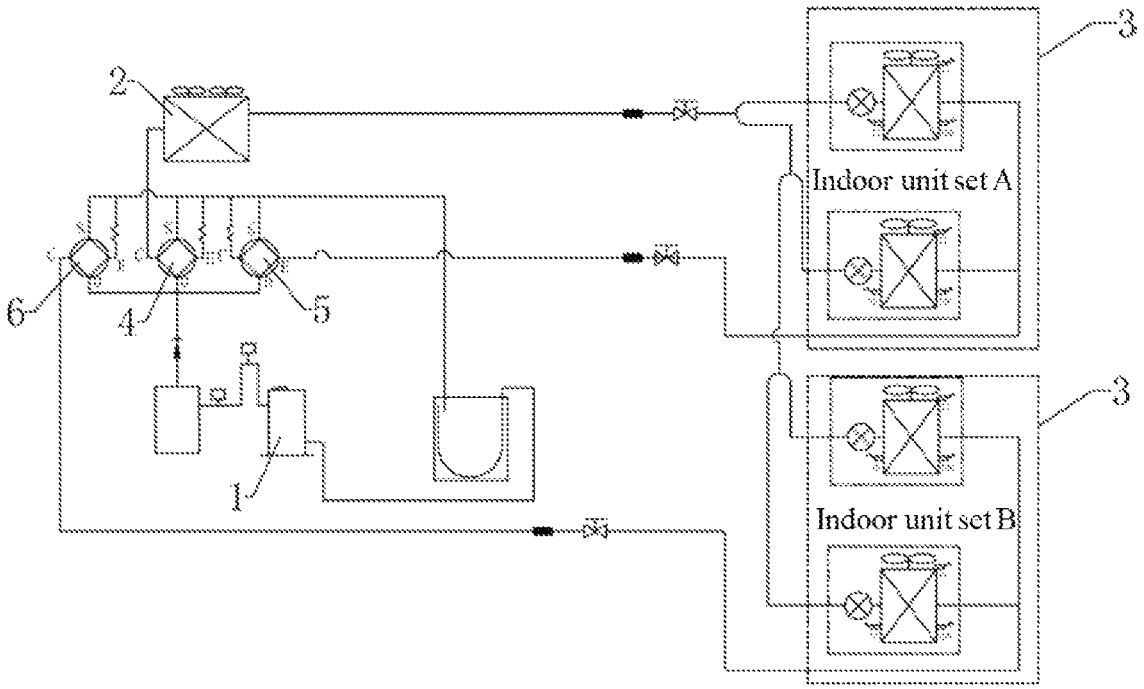
FIG. 1 is a schematic diagram of the composition of a multi-split system.

Referring to FIG. 1, in this embodiment, a multi-split system with partitioned control includes a compressor 1, an outdoor heat exchanger 2, two indoor unit sets 3, a first four-way valve 4, a second four-way valve 5, and a third four-way valve 6, wherein the first four-way valve 4, the second four-way valve 5, and the third four-way valve 6 each includes four interfaces (a first interface D, a second interface E, a third interface C, and a fourth interface S). Each indoor unit set 3 is composed of one or more indoor units arranged in parallel. The two indoor unit sets 3 may be arranged in different areas, and the two indoor unit sets 3 are controlled independently to achieve a partitioned cooling or heating function for different areas.

The specific connection composition of the multi-split system of the present embodiment is as follows: the output end of the compressor 1 is in communication with first interfaces D of the first four-way valve 4, the second four-way valve 5, and the third four-way valve 6 respectively via an oil separator, the third interface C of the first four-way valve 4 is in communication with one end of the outdoor heat exchanger 2, the second interface E of the second four-way valve 5 is in communication with one end of one indoor unit set 3 therein (this indoor unit set 3 is defined as A for convenience of explanation), and the third interface C of the third four-way valve 6 is in communication with one end of the other indoor unit set 3 (this indoor unit set 3 is defined as B for convenience of explanation). The remaining interfaces of the first four-way valve 4, the second four-way valve 5, and the third four-way valve 6 are all in communication with the air return end of the compressor 1 via a gas-liquid separator. The other end of the outdoor heat exchanger 2 is in communication with the other ends of the indoor unit sets 3 in a convergence manner.

Further, each indoor unit is configured with a room temperature sensor for detecting and obtaining an indoor ambient temperature T1, a refrigerant temperature sensor for detecting and obtaining an outlet temperature T2B, and a coil temperature sensor for detecting and obtaining a coil temperature T2.

Further, when the first four-way valve 4, the second four-way valve 5, and the third four-way valve 6 are powered off, for each four-way valve, the first interface D is connected with the third interface C, and the second interface E is connected with the fourth interface S; on the contrary, when the first four-way valve 4, the second four-way valve 5, and the third four-way valve 6 are powered on, for each four-way valve, the first interface D is connected with the fourth interface SC, and the second interface E is connected with the fourth interface S.

The operation mode will be explained below in conjunction with the multi-split system described above.

Figure 2:
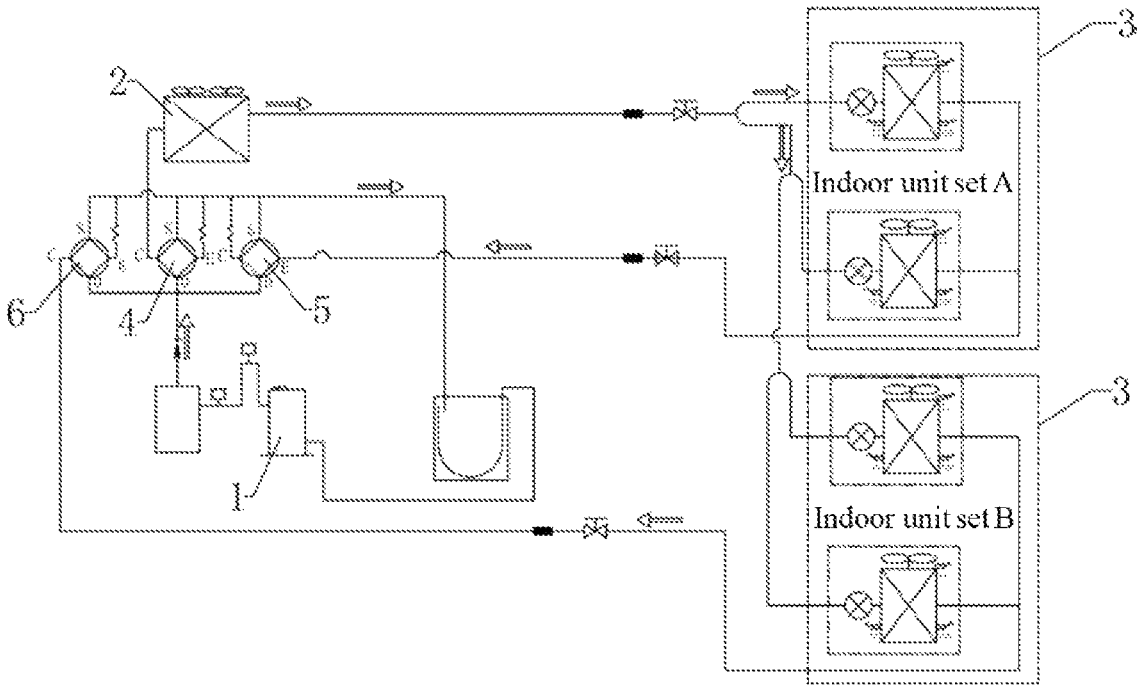
FIG. 2 is a schematic diagram in which the indoor unit set A and the indoor unit set B are in the cooling mode.

Specifically, as shown in FIG. 2, when the indoor unit set A and/or the indoor unit set B are/is in cooling demand, the first four-way valve 4 and the second four-way valve 5 are powered off, and the third four-way valve 6 is powered on; at this time, the high-temperature and high-pressure refrigerant output by the compressor 1 is divided into three parts, one part of the refrigerant flows to the outdoor heat exchanger 2 through the first four-way valve 4 for condensation and heat release, and the other two parts of the refrigerant flow back to the compressor 1 through the second four-way valve 5 and/or the third four-way valve 6 respectively; the refrigerant after condensation and heat release flows to the indoor unit set A and/or the indoor unit set B respectively for evaporation and heat absorption, and the refrigerant after heat absorption flows back to the air return end of the compressor 1 through the second four-way valve 5 and/or the third four-way valve 6 correspondingly. At this time, the indoor unit set 3 without the cooling demand may close the shut-off valve between the indoor unit set 3 and the corresponding four-way valve.

Figure 3:
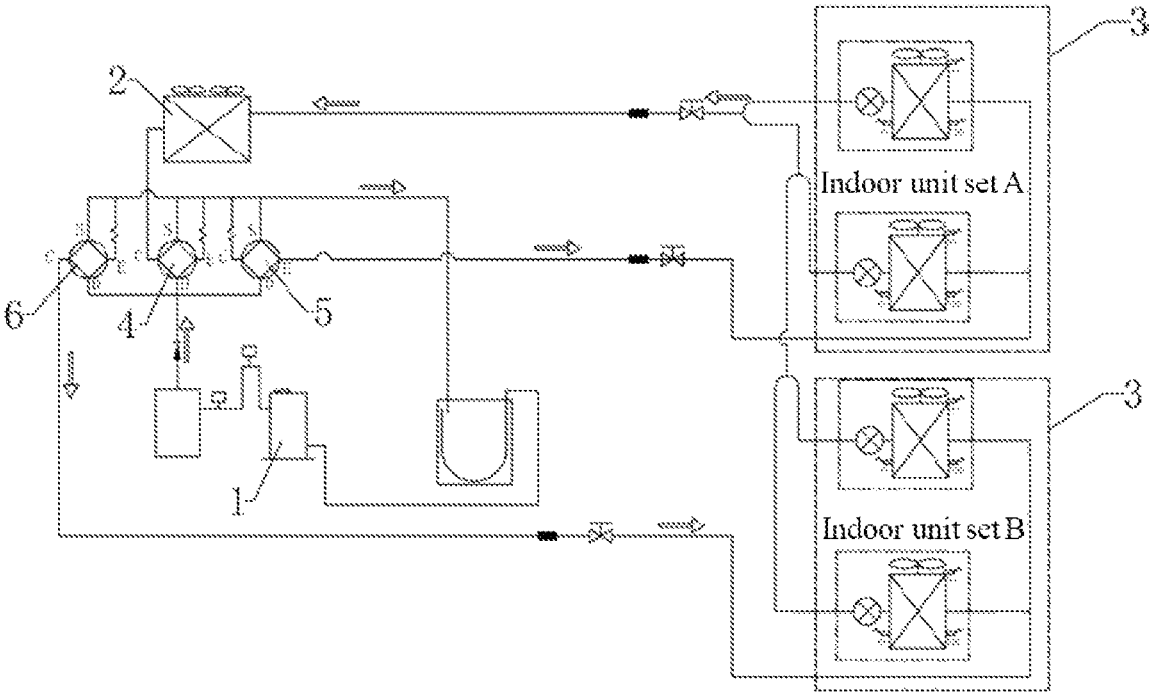
FIG. 3 is a schematic diagram in which the indoor unit set A and the indoor unit set B are in the heating mode.

Specifically, as shown in FIG. 3, when the indoor unit set A and/or the indoor unit set B are both in heating demand, the first four-way valve 4 and the second four-way valve 5 are powered on, and the third four-way valve 6 is powered off; at this time, the high-temperature and high-pressure refrigerant output by the compressor 1 is divided into three parts, one part of the refrigerant flows back to the air return end of the compressor 1 through the first four-way valve 4, and the other two parts of the refrigerant flows to the indoor unit set A and the indoor unit set B through the second four-way valve 5 and/or the third four-way valve 6 respectively for condensation and heat release, the refrigerant after heat release flows to the outdoor heat exchanger 2 for evaporation and heat absorption, and then flows back to the air return end of the compressor 1 through the first four-way valve 4. At this time, the indoor unit set 3 without the heating demand may close the shut-off valve between the indoor unit set 3 and the corresponding four-way valve.

Figure 4:
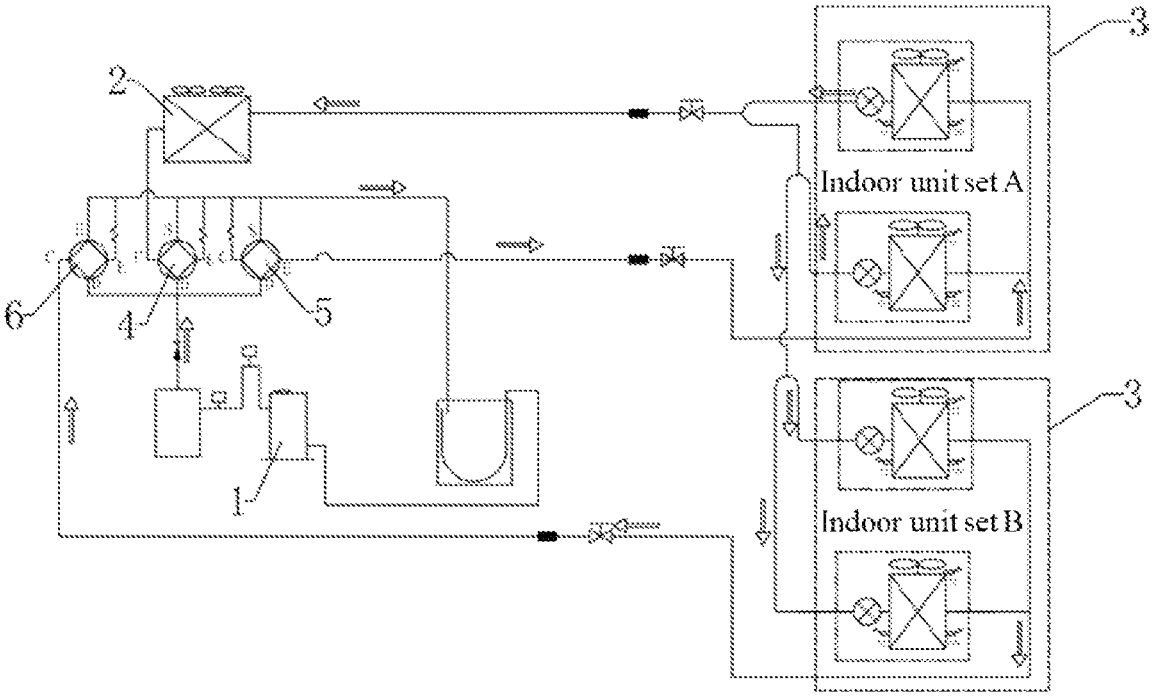
FIG. 4 is a schematic diagram in which the indoor unit set A is in the heating mode and the indoor unit set B is in the cooling mode.
Figure 5:
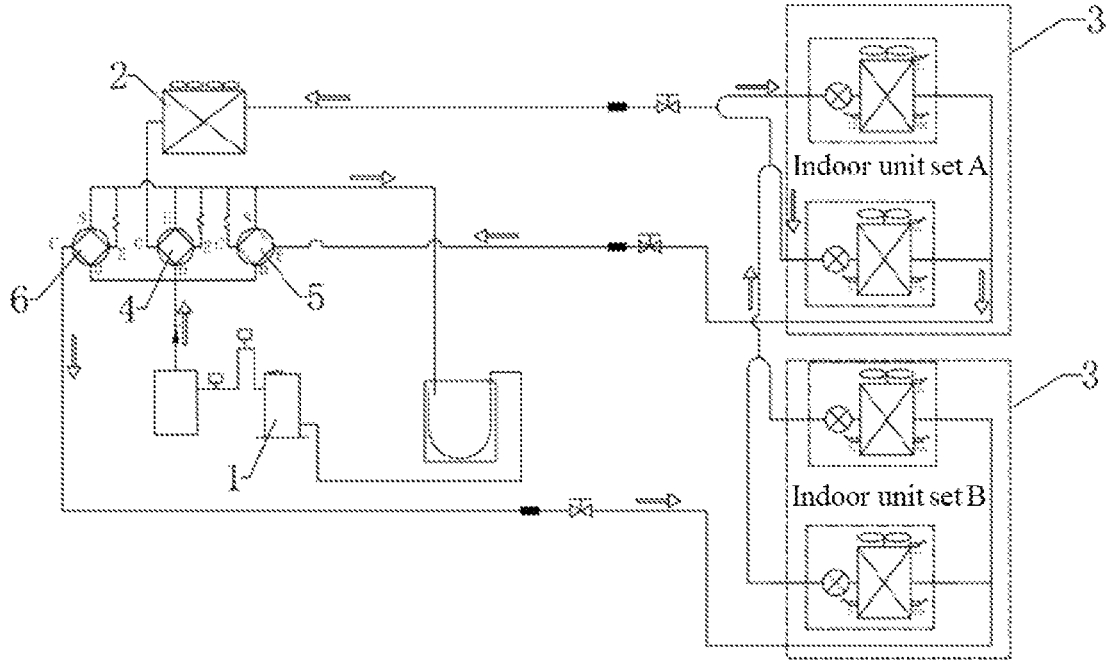
FIG. 5 is a schematic diagram in which the indoor unit set A is in the cooling mode and the indoor unit set B is in the heating mode.

Specifically, when any one of the indoor unit sets 3 is in cooling demand and the other indoor unit set 3 is in heating demand, for ease of description, referring to FIG. 5, if it is defined that the indoor unit set A is in cooling demand and the indoor unit set B is in heating demand, then the first four-way valve 4 is powered on, and both the second four-way valve 5 and the third four-way valve 6 are powered off; at this time, the high-temperature and high-pressure refrigerant output by the compressor 1 is divided into three parts, two parts of the refrigerant flow back to the air return end of the compressor 1 through the first four-way valve 4 and the second four-way valve 5, and the other part of the refrigerant flows through the third four-way valve 6 and the indoor unit set B respectively for condensation and heat release, this part of refrigerant after heat release is divided into two parts which flow into the outdoor heat exchanger 2 and the indoor unit set A respectively for evaporation and heat absorption, and the refrigerant after evaporation and heat absorption flows back to the air return end of the compressor 1 through the first four-way valve 4 and the second four-way valve 5 respectively. On the contrary, as shown in FIG. 4, if it is defined that the indoor unit set A is in heating demand and the indoor unit set B is in cooling demand, then the first four-way valve 4, the second four-way valve 5, and the third four-way valve 6 are all powered on, at this time, the high-temperature and high-pressure refrigerant output by the compressor 1 is divided into three parts, two parts of the refrigerant flow back to the air return end of the compressor 1 through the first four-way valve 4 and the third four-way valve 6, and the other part of the refrigerant flows to the indoor unit set A through the second four-way valve 5 for condensation and heat release, and this part of refrigerant after heat release is divided into two parts which flow into the outdoor heat exchanger 2 and the indoor unit set B respectively for evaporation and heat absorption, and the refrigerant after evaporation and heat absorption flows back to the air return end of the compressor 1 through the first four-way valve 4 and the third four-way valve 6 respectively. In this way, it is achieved that two indoor unit sets 3 in different areas can independently perform cooling and heating respectively.

Figure 6:
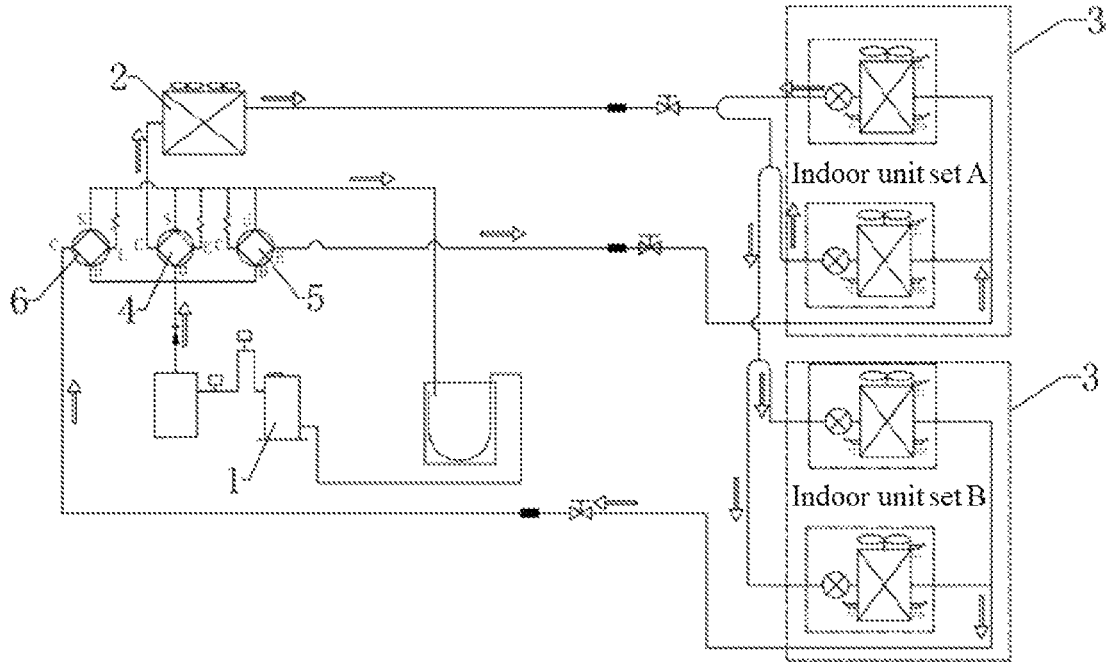
FIG. 6 is a schematic diagram in which the indoor unit set B is in the cooling mode and the outdoor heat exchanger is defrosting.
Figure 7:
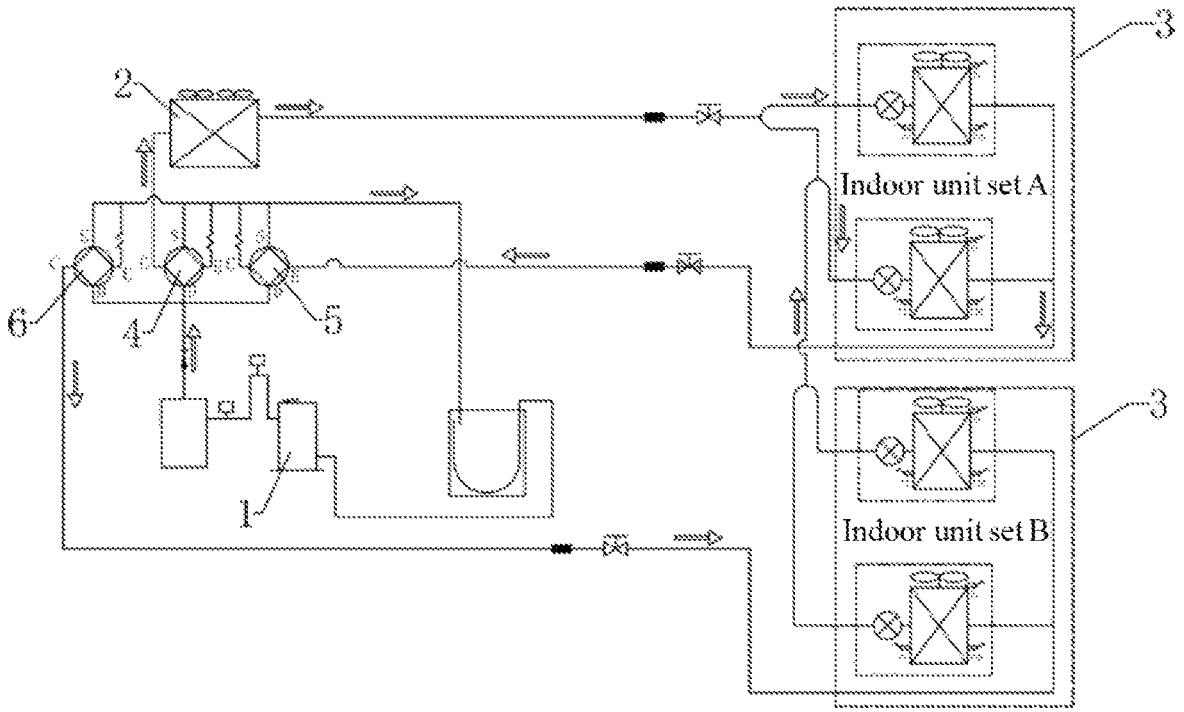
FIG. 7 is a schematic diagram in which the indoor unit set A is in the cooling mode and the outdoor heat exchanger is defrosting.

Further, if the system monitors that the outdoor heat exchanger 2 is frosted in a low-temperature outdoor environment and there is no indoor unit set 3 in cooling demand, it will be processed according to the conventional defrosting logic, which is not described herein. If it is detected that frosting occurs and there is an indoor unit set 3 in cooling demand, for ease of description, as shown in FIG. 7, it is defined herein that the indoor unit set A is in cooling demand, the indoor unit set B is in heating demand, and the outdoor heat exchanger 2 is frosted; then, the first four-way valve 4, the second four-way valve 5, and the third four-way valve 6 are all powered off, and at this time, the high-temperature and high-pressure refrigerant output by the compressor 1 is divided into three parts, a part of the refrigerant flows back to the air return end of the compressor 1 through the second four-way valve 5, and the other two parts of the refrigerant flow to the outdoor heat exchanger 2 and the indoor unit set B through the first four-way valve 4 and the third four-way valve 6 respectively for condensation and heat release, and these two parts of the refrigerant after heat release converge and flow into the indoor unit set A for evaporation and heat absorption, and the refrigerant after evaporation and heat absorption flows back to the air return end of the compressor 1 through the second four-way valve 5. On the contrary, as shown in FIG. 6, if it is defined that the indoor unit set A is in heating demand, the indoor unit set B is in cooling demand, and the outdoor heat exchanger 2 is frosted, then, the first four-way valve 4 is powered off, and both the second four-way valve 5 and the third four-way valve 6 are powered on, at this time, the high-temperature and high-pressure refrigerant output by the compressor 1 is divided into three parts, one part of the refrigerant flows back to the air return end of the compressor 1 through the third four-way valve 6, and the other two parts of the refrigerant flow to the outdoor heat exchanger 2 and the indoor unit set A through the first four-way valve 4 and the second four-way valve 5 respectively for condensation and heat release, and these two parts of the refrigerant after heat release converge and flow into the indoor unit set B for evaporation and heat absorption, and the refrigerant after evaporation and heat absorption flows back to the air return end of the compressor 1 through the third four-way valve 6. The outdoor heat exchanger 2 is defrosted in time by using two indoor unit sets 3 that have cooling demand in different areas, and it will not disturb the indoor units 3 in normal heating demand.

Based on the multi-split system described above, the following is further explained in conjunction with the self-identification control method.

In this embodiment, a self-identification control method for a multi-split system with partitioned control includes the following steps: S1: detecting and obtaining, before completion of wiring and initial startup of the system, a standby temperature parameter Ta of each indoor unit before it is turned on; S2: powering on and initially starting the system, controlling the first four-way valve 4, the second four-way valve 5, and the third four-way valve 6 to be powered off, so that the first interface D of each four-way valve is connected with the third interface C of the four-way valve, then continuously running for a rated time, and detecting and obtaining a current operating temperature parameter Tb of each indoor unit; in step S2, if there is no wiring or pipeline abnormality in the system, at this time, the high-temperature and high-pressure refrigerant outputted by the compressor 1 is divided into three parts, the first part of the refrigerant flows into the outdoor heat exchanger 2 through the first four-way valve 4, the second part of the refrigerant flows back to the compressor 1 through the second four-way valve 5, and the third part of the refrigerant flows to some of indoor units through the third four-way valve 6. At this time, the refrigerant flowing out through the third four-way valve 6 condenses and releases heat in the indoor units, thereby flow to the indoor unit in communication with the third four-way valve 6 to perform heating, while the refrigerant flowing out through the first four-way valve 4 condenses and releases heat in the outdoor heat exchanger 2, and then the two parts of refrigerant after condensation and heat release enter the indoor unit in communication with the second four-way valve 5 for evaporation and heat absorption, thereby flow to the indoor unit in communication with the second four-way valve 5 to perform cooling.

S3: sequentially comparing the standby temperature parameter Ta and the operating temperature parameter Tb of each indoor unit, wherein the indoor unit whose standby temperature parameter Ta is greater than the operating temperature parameter Tb is initially classified into the indoor unit set A, and the indoor unit whose standby temperature parameter Ta is less than the operating temperature parameter Tb is initially classified into the indoor unit set B; in step S3, by monitoring the operating temperature parameter Tb, it is reflected whether the system running in step S2 is normal; specifically, if an indoor unit has a standby temperature parameter Ta greater than its operating temperature parameter Tb, it means that this part of indoor unit is an indoor unit in communication with the second four-way valve 5 and runs in the cooling mode, at this time, this part of indoor unit is initially classified into the indoor unit set A; if an indoor unit has a standby temperature parameter Ta less than its operating temperature parameter Tb, it means that this part of indoor unit is an indoor unit in communication with the third four-way valve 6 and runs in the heating mode, at this time, this part of indoor unit is initially classified into the indoor unit set B.

In addition, if there is a case where the standby temperature parameter Ta of an individual indoor unit is equal to its operating temperature parameter Tb, it means that there is wiring or pipeline abnormality, and manual inspection is required.

S4: controlling the first four-way valve 4 to be powered off, controlling the second four-way valve 5 and the third four-way valve 6 to be powered on for reversing, so that both the second four-way valve 5 and the third four-way valve 6 are reversed and the first interfaces D thereof are connected with the second interfaces E, then continuously running for a rated time, and detecting and obtaining the current operating temperature parameter Tc of each indoor unit; in step S4, if there is no wiring or pipeline abnormality in the system, at this time, the second four-way valve 5 and the third four-way valve 6 are powered on and reversed, so that the indoor unit which originally performs heating in step S2 is converted to perform cooling, and the indoor unit which originally performs cooling in step S2 is converted to perform heating.

S5. sequentially comparing the standby temperature parameter Ta and the operating temperature parameter Tc of each indoor unit, wherein the indoor unit whose standby temperature parameter Ta is less than the operating temperature parameter Tc is initially classified into the indoor unit set A, and the indoor unit whose standby temperature parameter Ta is greater than the operating temperature parameter Tc is initially classified into the indoor unit set B; in step S5, by detecting the operating temperature parameter Tc, it is reflected whether the system running in step S4 is normal; specifically, if an indoor unit has a standby temperature parameter Ta less than its operating temperature parameter Tc, it means that this part of indoor unit is successfully switched from the original cooling mode to the heating mode, which is an indoor unit in communication with the second four-way valve 5, and at this time, this part of indoor unit is initially classified into the indoor unit set A; if an indoor unit has a standby temperature parameter Ta greater than its operating temperature parameter Tc, it means that this part of indoor unit is successfully switched from the original heating mode to the cooling mode, which is an indoor unit in communication with the third four-way valve 6, and at this time, this part of indoor unit is initially classified into the indoor unit set B.

In addition, if there is a case where the standby temperature parameter Ta of an individual indoor unit is equal to its operating temperature parameter Tc, it means that there is wiring or pipeline abnormality, and manual inspection is required.

S6: checking and comparing the classification results of each indoor unit in steps S3 and S5, wherein if the two classification results of any indoor unit are the same, it is determined that the indoor unit is normally wired and the indoor unit is marked as that its corresponding indoor unit set A or B has been confirmed. That is, the classification is performed twice in steps S3 and S5, and it is determined that there is no abnormality if the classification results are the same, and then marking for confirmation is performed, so that the controller subsequently performs partitioned control on the indoor unit set A or the indoor unit set B in different areas.

Further, the standby temperature parameter Ta, the operating temperature parameter Tb, and the operating temperature parameter Tc are any one or more temperature parameter(s) of the indoor ambient temperature T1, the outlet temperature T2B, and the coil temperature T2.

In order to further improve the determination accuracy in step S3 and step S5, in the present embodiment, the standby temperature parameter Ta, the operating temperature parameter Tb, and the operating temperature parameter Tc include three temperature parameters of indoor ambient temperature T1, outlet temperature T2B, and coil temperature T2.

Specifically, in step S3, for any indoor unit, if the standby temperature parameter Ta>the operating temperature parameter Tb, the indoor ambient temperature T1>the outlet temperature T2B, and the indoor ambient temperature T1>the coil temperature T2, then, the indoor unit is initially classified into the indoor unit set A; if the standby temperature parameter Ta<the operating temperature parameter Tb, the indoor ambient temperature T1<the outlet temperature T2B, and the indoor ambient temperature T1<the coil temperature T2, the indoor unit is initially classified into the indoor unit set B. Specifically, in step S5, for any indoor unit, if the standby temperature parameter Ta<the operating temperature parameter Tc, the indoor ambient temperature T1<the outlet temperature T2B, and the indoor ambient temperature T1<the coil temperature T2, the indoor unit is initially classified into the indoor unit set A; if the standby temperature parameter Ta>the operating temperature parameter Tc, the indoor ambient temperature T1>the outlet temperature T2B, and the indoor ambient temperature T1>the coil temperature T2, the indoor unit is initially classified into the indoor unit set B. Thus, the accuracy of the determination is further improved.

In the present embodiment, the rated time is 20 min.

The embodiments described above are only preferred embodiments and are not intended to limit the present disclosure in any form. Any person skilled in the art, without departing from the scope of the technical solutions of the present disclosure, makes more possible variations, modifications, or amendments to the technical solutions of the present disclosure by using the technical contents disclosed above are all equivalent embodiments of the present disclosure. For this reason, all equivalent changes made according to the idea of the present disclosure without departing from the content of the technical solutions of the present disclosure should be covered within the scope of protection of the present disclosure.

What is claimed is:

1. A multi-split system with partitioned control, comprising:

a compressor (1), an outdoor heat exchanger (2), two indoor unit sets (3), a first four-way valve (4), a second four-way valve (5), and a third four-way valve (6), wherein each of the indoor unit sets (3) is composed of two or more indoor units (3) arranged in parallel;

an output end of the compressor (1) is respectively in communication with first interfaces (D) of the first four-way valve (4), the second four-way valve (5), and the third four-way valve (6), a third interface (C) of the first four-way valve (4) is in communication with a first end of the outdoor heat exchanger (2), a second interface (E) of the second four-way valve (5) is in communication with a first end of one indoor unit set (3) therein, a third interface (C) of the third four-way valve (6) is in communication with a first end of the other indoor unit set (3), and a second end of the outdoor heat exchanger (2) is in communication with second ends of the indoor unit sets (3) in a convergence manner;

additional interfaces of the second four-way valve (5) and the third four-way valve (6) are all in communication with a return end of the compressor (1); and by independently adjusting power on/off actions of the second four-way valve (5) and the third four-way valve (6), a heating mode or a cooling mode of each indoor unit set (3) is controlled correspondingly and independently.

2. The multi-split system with partitioned control according to claim 1, wherein: each indoor unit is configured with a room temperature sensor for detecting and obtaining an indoor ambient temperature (T1), a refrigerant temperature sensor for detecting and obtaining an outlet temperature (T2B), and a coil temperature sensor for detecting and obtaining a coil temperature (T2).

3. A self-identification control method for the multi-split system with partitioned control according to claim 1, the method comprising:

S1: detecting and obtaining, before completion of wiring and initial startup of the system, a standby temperature parameter (Ta) of each indoor unit before it is turned on;

S2: powering on and initially starting the system, controlling the first four-way valve (4), the second four-way valve (5) and the third four-way valve (6) to be powered off, so that the first interface (D) of each four-way valve is connected with the third interface (C) of the four-way valve, then continuously running for a rated time, and detecting and obtaining the current operating temperature parameter (Tb) of each indoor unit;

S3: sequentially comparing the standby temperature parameter (Ta) and the operating temperature parameter (Tb) of each indoor unit, wherein the indoor unit whose standby temperature parameter (Ta) is greater than the operating temperature parameter (Tb) is initially classified into an indoor unit set (A), and the indoor unit whose standby temperature parameter (Ta) is less than the operating temperature parameter (Tb) is initially classified into an indoor unit set (B);

S4: controlling the first four-way valve (4) to be powered off, controlling the second four-way valve (5) and the third four-way valve (6) to be powered on for reversing, so that both the second four-way valve (5) and the third four-way valve (6) are reversed and the first interfaces (D) thereof are connected with the second interfaces (E), then continuously running for a rated time, and detecting and obtaining the current operating temperature parameter (Tc) of each indoor unit;

S5: sequentially comparing the standby temperature parameter (Ta) and the operating temperature parameter (Tc) of each indoor unit, wherein the indoor unit whose standby temperature parameter (Ta) is less than the operating temperature parameter (Tc) is initially classified into the indoor unit set (A), and the indoor unit whose standby temperature parameter (Ta) is greater than the operating temperature parameter (Tc) is initially classified into the indoor unit set (B); and S6: checking and comparing the classification results of each indoor unit in steps S3 and S5, wherein if the two classification results of any indoor unit are the same, it is determined that the indoor unit is normally wired and the indoor unit is marked as that its corresponding indoor unit set (A) or (B) has been confirmed.

4. The self-identification control method for the multi-split system with partitioned control according to claim 3, wherein: the standby temperature parameter (Ta), the operating temperature parameter (Tb), and the operating temperature parameter (Tc) are any one or more temperature parameter(s) of the indoor ambient temperature (T1), the outlet temperature (T2B), and the coil temperature (T2).

5. The self-identification control method for the multi-split system with partitioned control according to claim 3, wherein: the standby temperature parameter (Ta), the operating temperature parameter (Tb), and the operating temperature parameter (Tc) include three temperature parameters of indoor ambient temperature (T1), outlet temperature (T2B), and coil temperature (T2).

6. The self-identification control method for the multi-split system with partitioned control according to claim 5, wherein: in step S3, for any indoor unit, if the standby temperature parameter (Ta)>the operating temperature parameter (Tb), the indoor ambient temperature (T1)>the outlet temperature (T2B), and the indoor ambient temperature (T1)>the coil temperature (T2), the indoor unit is initially classified into the indoor unit set (A); if the standby temperature parameter (Ta)<the operating temperature parameter (Tb), the indoor ambient temperature (T1)<the outlet temperature (T2B), and the indoor ambient temperature (T1)<the coil temperature (T2), the indoor unit is initially classified into the indoor unit set (B).

7. The self-identification control method for the multi-split system with partitioned control according to claim 5, wherein: in step S5, for any indoor unit, if the standby temperature parameter (Ta)<the operating temperature parameter (Tc), the indoor ambient temperature (T1)<the outlet temperature (T2B), and the indoor ambient temperature (T1)<the coil temperature (T2), the indoor unit is initially classified into the indoor unit set (A); if the standby temperature parameter (Ta)>the operating temperature parameter (Tc), the indoor ambient temperature (T1)>the outlet temperature (T2B), and the indoor ambient temperature (T1)>the coil temperature (T2), the indoor unit is initially classified into the indoor unit set (B).

8. The self-identification control method for the multi-split system with partitioned control according to claim 5, wherein: the rated time is 20 min.

* * * * *